US011112141B2

(12) United States Patent
Vogel

(10) Patent No.: US 11,112,141 B2
(45) Date of Patent: Sep. 7, 2021

(54) RAIN HOOD WITH AIR FLOW SENSOR

(71) Applicant: Air Distribution Technologies IP, LLC, Milwaukee, WI (US)

(72) Inventor: Timothy A. Vogel, Independence, MO (US)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 198 days.

(21) Appl. No.: 16/264,435

(22) Filed: Jan. 31, 2019

(65) Prior Publication Data

US 2020/0217551 A1 Jul. 9, 2020

Related U.S. Application Data

(60) Provisional application No. 62/789,895, filed on Jan. 8, 2019.

(51) Int. Cl.

| | |
|---|---|
| ***F24F 11/89*** | (2018.01) |
| ***F24F 13/08*** | (2006.01) |
| *F24F 110/40* | (2018.01) |
| *F24F 110/12* | (2018.01) |
| *F24F 110/32* | (2018.01) |

(52) U.S. Cl.

CPC ..... *F24F 11/89* (2018.01); *F24F 13/082* (2013.01); *F24F 2110/12* (2018.01); *F24F 2110/32* (2018.01); *F24F 2110/40* (2018.01); *F24F 2221/16* (2013.01); *F24F 2221/52* (2013.01)

(58) Field of Classification Search

CPC .... F24F 11/89; F24F 2221/52; F24F 2221/16; F24F 2221/17; F24F 2110/32; F24F 2110/40

USPC ..... 454/275–276, 283

See application file for complete search history.

(56) References Cited

U.S. PATENT DOCUMENTS

| | | | | |
|---|---|---|---|---|
| 4,506,655 | A | 3/1985 | Kuechler | |
| 6,629,886 | B1 * | 10/2003 | Estepp | F24F 11/745 454/229 |
| 7,421,911 | B2 * | 9/2008 | Desrochers | G01N 1/26 374/141 |
| 7,891,573 | B2 | 2/2011 | Finkam et al. | |
| 2006/0174560 | A1 | 8/2006 | Levine et al. | |
| 2009/0143915 | A1 * | 6/2009 | Dougan | F24F 11/0001 700/276 |
| 2010/0024244 | A1 | 2/2010 | Potter | |
| 2011/0286173 | A1 * | 11/2011 | Moore | G11B 33/122 361/679.31 |
| 2012/0270488 | A1 * | 10/2012 | Fujimura | F24F 11/0001 454/56 |

(Continued)

OTHER PUBLICATIONS

Johnson Controls; "AD-1252 Thermal Dispersion Probe Airflow Measuring System," Jul. 25, 2014, pp. 1-23.

(Continued)

*Primary Examiner* — Steven B McAllister
*Assistant Examiner* — Ko-Wei Lin
(74) *Attorney, Agent, or Firm* — Fletcher Yoder, P.C.

(57) ABSTRACT

An air handling unit includes a rain hood configured to receive an air flow from an external environment surrounding the rain hood, and a sensor disposed within the rain hood and configured to monitor air flow parameters indicative of a flow rate of the air flow.

22 Claims, 14 Drawing Sheets

(56) References Cited

U.S. PATENT DOCUMENTS

| | | | | |
|---|---|---|---|---|
| 2014/0096562 | A1* | 4/2014 | McDonnell | F28C 1/14 62/525 |
| 2017/0059184 | A1 | 3/2017 | Haynes et al. | |

OTHER PUBLICATIONS

PCI; "Air Monitoring Equipment, Building Hvac & LEED Green Buildings", Website: http://www.paragoncontrols.com/pressure_measurement_AboutInstallationGuidelines.aspx, Jan. 31, 2019, pp. 1-5.

* cited by examiner

RAIN HOOD WITH AIR FLOW SENSOR

CROSS REFERENCE TO RELATED APPLICATIONS

This application claims priority from and the benefit of U.S. Provisional Application Ser. No. 62/789,895, entitled "RAIN HOOD WITH AIR FLOW SENSOR," filed Jan. 8, 2019, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates generally to a heating, ventilation, and/or air conditioning (HVAC) system. More particularly, the present disclosure is directed toward air flow monitoring of an air flow received by an air handling unit (AHU).

A wide range of applications exist for HVAC systems. For example, residential, light commercial, commercial, and industrial systems are used to control temperatures and air quality in residences and buildings. Generally, HVAC systems may circulate a fluid, such as a refrigerant, through a closed loop between an evaporator coil, where the fluid absorbs heat, and a condenser, where the fluid releases heat. The fluid flowing within the closed loop is generally formulated to undergo phase changes within the normal operating temperatures and pressures of the system, so that quantities of heat can be exchanged by virtue of the latent heat of vaporization of the fluid. A fan or fans may blow air over the coils of the heat exchanger(s) in order to condition the air. In other embodiments, a chiller and boiler may be utilized to cool and heat water, and the above-described fan or fans may blow air over, for example, a conduit which receives the temperature-controlled water. The air may then be routed toward a space, through ductwork, for example, to condition the space.

Traditional air handling units (AHUs) of traditional HVAC systems may include air flow monitoring features installed in AHU components which are difficult to access, causing cumbersome and expensive installation and maintenance processes. Thus, improved air handling units and flow monitoring features are desired.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to an air handling unit having a rain hood configured to receive an air flow from an external environment surrounding the rain hood, and having a sensor disposed within the rain hood and configured to monitor air flow parameters indicative of a flow rate of the air flow.

The present disclosure relates to an air handling unit. The air handling unit includes a rain hood frame defining a rain hood interior and having an air input opening configured to receive an air flow from an external environment surrounding the rain hood frame. The air handling unit also includes an air flow sensor disposed within the rain hood interior and configured to monitor air flow parameters indicative of a flow rate of the air flow. The air handling unit also includes an electronics enclosure disposed at least partially within the external environment and having electronic circuitry disposed therein, where the air flow sensor is communicatively coupled to the electronic circuitry.

The present disclosure relates to a heating, ventilation, and/or air conditioning (HVAC) system. The HVAC system includes a rain hood frame defining a rain hood interior and having an air input opening configured to receive an air flow from an external environment surrounding the rain hood frame. The rain hood frame includes a sensor access opening through a wall of the rain hood frame. The HVAC system also includes an air flow sensor disposed within the rain hood interior and configured to monitor air flow parameters indicative of a flow rate of the air flow. The HVAC system also includes an electronics enclosure disposed at least partially within the external environment and having electronic circuitry disposed therein, where the electronic circuitry interfaces with the air flow sensor through the sensor access opening.

DRAWINGS

DETAILED DESCRIPTION

Figure 1:
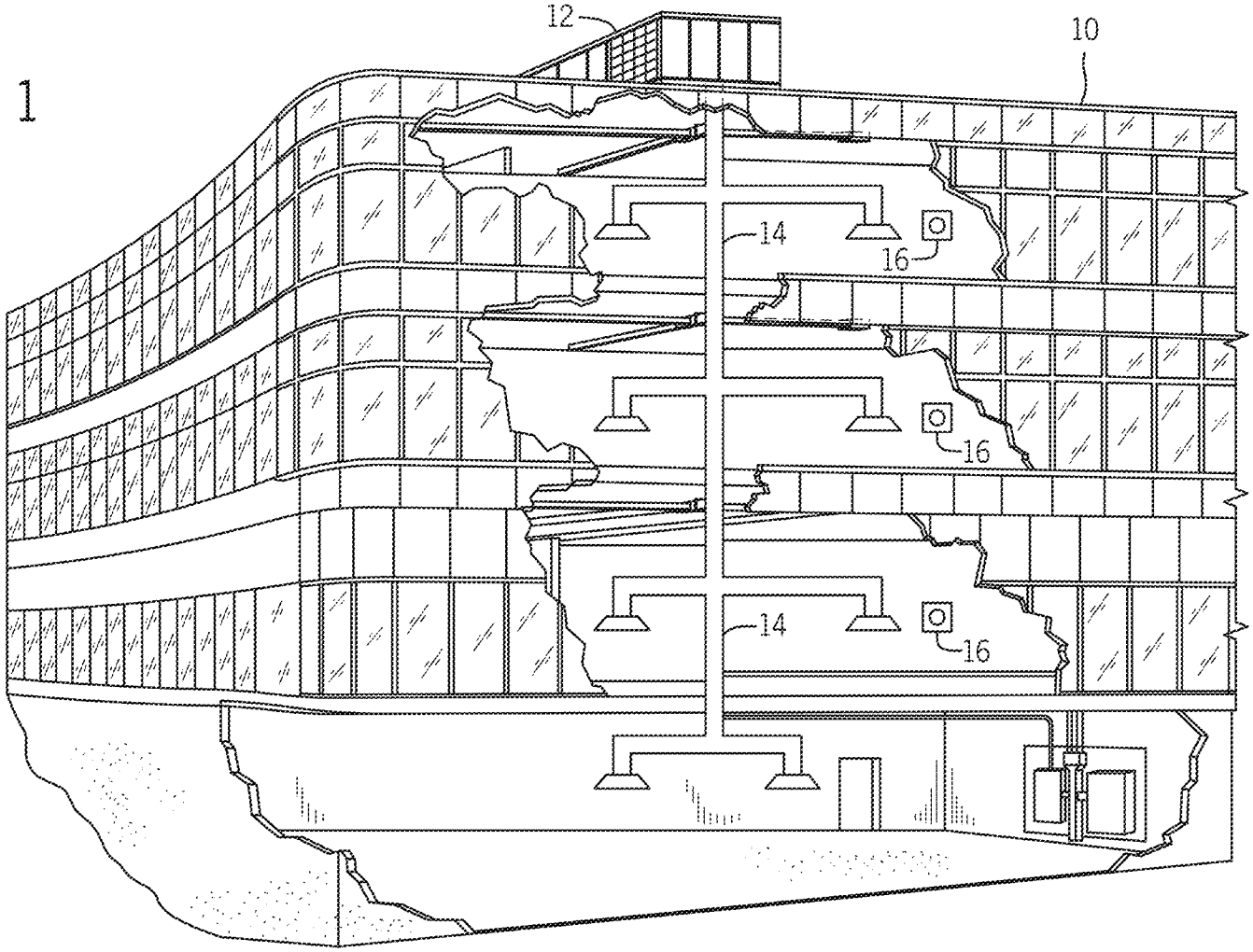
FIG. 1 is a perspective view a heating, ventilation, and/or air conditioning (HVAC) system for building environmental management, in accordance with embodiments described herein.

The present disclosure relates generally to a heating, ventilation, and/or air conditioning system. More particularly, the present disclosure is directed toward a rain hood and air flow monitoring of an air flow through the rain hood.

Traditional air handling units (AHUs) of traditional HVAC systems may include air flow monitoring features installed in AHU components which are difficult to access, causing cumbersome and expensive installation and maintenance processes. In accordance with present embodiments, an AHU may include a rain hood and a body, where the rain hood is configured to receive an air flow from an external environment into a body of the AHU and to block ingress of liquids and contaminants into the body of the AHU. The rain hood may include a rain hood frame defining a rain hood interior and separating the rain hood interior from the external environment. The frame may include an air input opening configured to receive an air flow into the rain hood interior. The frame may also include an air output opening through which the air flow passes into the body of the AHU and/or ductwork which guides the air flow toward other HVAC components. In general, the rain hood and corresponding frame is configured to block liquid and/or other environmental contaminants from entering the AHU. In some embodiments, the rain hood may include one or more filters disposed over the air input opening and/or disposed in other portions of the rain hood to block ingress of liquids and contaminants. Further, the air input opening of the rain hood may face downwardly, with respect to gravity, such that liquid is not gravity-fed into the rain hood.

In accordance with present embodiments, a sensor configured to detect air flow parameters indicative of a flow rate of the air flow through the rain hood interior may be disposed within the rain hood interior. An electronics enclosure having electronic circuitry coupled to the sensor may be disposed at least partially within the external environment surrounding the rain hood. The electronics enclosure may include water-resistant components configured to block ingress of liquids into the electronics enclosure. For example, the electronics enclosure and corresponding water-resistant components may provide a degree of protection against ingress of water, including rain, sleet, snow, splashing water, and hose directed water, and may also protect internal components from damage due to formation of ice. In particular, the electronics enclosure and corresponding water-resistant components may be configured to exclude at least 65 gallons per minute (GPM) of water from a 1-inch nozzle delivered from a distance not less than 10 feet for 5 minutes.

In some embodiments, a sensor access opening through a wall of the rain hood frame may facilitate an electrical connection between the sensor and the electronic circuitry contained within the electronics enclosure. That is, an electrical connection may extend from the electronic circuitry, through the sensor access opening, and to the sensor disposed within the rain hood interior. These and other features of the present disclosure are described in detail below.

Turning now to the drawings, FIG. 1 illustrates a heating, ventilation, and/or air conditioning (HVAC) system for building environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single, packaged unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It should be appreciated that any of the features described herein may be incorporated with the HVAC unit 12, residential heating and cooling systems, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, in accordance with an aspect of the present disclosure, the HVAC unit 12 may include an air handling unit (AHU), as previously described. The AHU may include a rain hood having a rain hood frame defining a rain hood interior and separating the rain hood interior from an external environment. The frame may include an air input opening configured to receive an air flow therethrough into the rain hood interior. The frame may also include an air output opening through which the air flow passes to, for example, ductwork that guides the air flow toward other HVAC components. In general, the rain hood and corresponding frame are configured to block liquids and/or other environmental contaminants from entering the air handling unit. In some embodiments, the rain hood may include one or more filters disposed over the air input opening and/or disposed in other portions of the rain hood to block ingress of liquids.

In accordance with present embodiments, a sensor configured to detect air flow parameters indicative of a flow rate of the air flow through the rain hood interior may be disposed within the rain hood interior. An electronics enclosure having electronic circuitry coupled to the sensor may be disposed at least partially within the external environment surrounding the rain hood. The electronics enclosure may include water-resistant components configured to block ingress of liquids into the electronics enclosure. For example, the electronics enclosure and corresponding water-resistant components may provide a degree of protection against ingress of water, including rain, sleet, snow, splashing water, and hose directed water, and may also protect internal components from damage due to formation of ice. In particular, the electronics enclosure and corresponding water-resistant components may be configured to exclude at least 65 gallons per minute (GPM) of water from a 1-inch nozzle delivered from a distance not less than 10 feet for 5 minutes.

In some embodiments, a sensor access opening through a wall of the rain hood frame may facilitate an electrical connection between the sensor and the electronic circuitry contained within the electronics enclosure. That is, an electrical connection may extend from the electronic circuitry, through the sensor access opening, and to the sensor disposed within the rain hood interior. Each of these features may be incorporated in the AHU of HVAC unit 12 in FIG. 1 and are described in further detail below.

Figure 2:
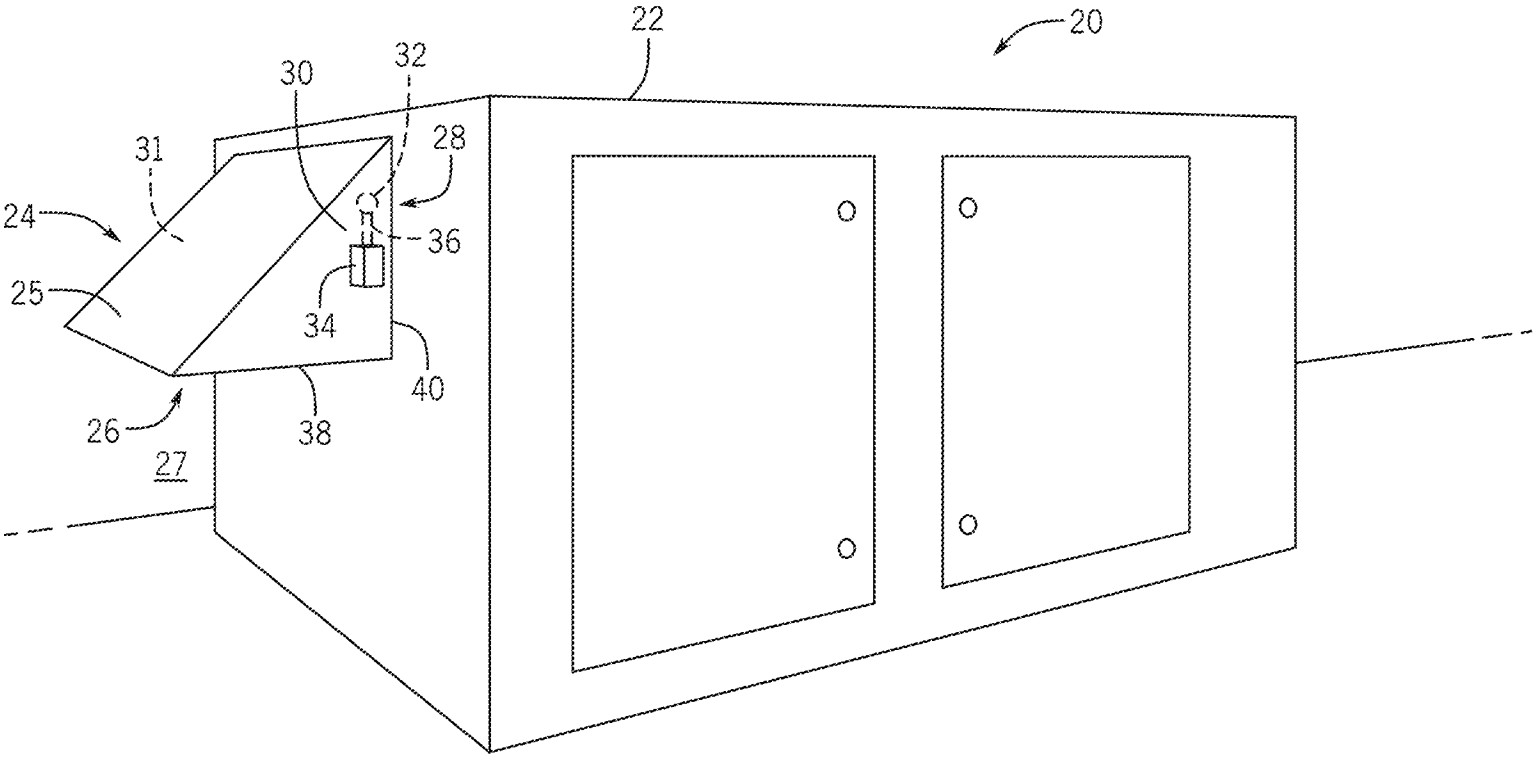
FIG. 2 is perspective view of an air handling unit (AHU) for use in the HVAC system of FIG. 1, illustrating a rain hood of the AHU, in which a sensor configured to detect air flow parameters is disposed, in accordance with embodiments described herein.

FIG. 2 is a perspective view of an air handling unit (AHU) 20 having a body 22 and a rain hood 24 coupled or attached to the body 22. The rain hood 24 may include a rain hood frame 25. The frame 25 includes an air input opening 26 which receives an air flow from an external environment 27 surrounding the rain hood 24. The air flow may be induced from the external environment 27 via, for example, a fan or blower disposed in the body 22 of the AHU 20 or elsewhere in an HVAC system having the AHU 20. The frame 25 of the rain hood 24 also includes an air output opening 28 which outputs the air flow from the rain hood 24 and into the body 22 of the AHU 20. A coupling of the rain hood frame 25 to the body 22 of the AHU 20 may block leakage of the air flow. The body 22 may receive the air flow and deliver the air flow to other HVAC components, such as air flow or temperature-control components within the body 22, and/or a duct coupled to output openings of the body 22. In some embodiments, the rain hood 24 may include a filter (not shown), such as a mesh screen, over the air input opening 26 of the frame 25. The filter may operate to block ingress of liquids into the frame 25 and subsequently into the body 22 of the AHU 20.

In accordance with present embodiments, a sensor 32, such as an air flow sensor, may be disposed within an interior 31 of the frame 25 of the rain hood 24, and may be coupled to an electronics enclosure 34 mounted or disposed at least partially external to a wall 30 of the frame 25. For example, the electronics enclosure 34 may include electronic circuitry coupled to the sensor 32 via an electrical connection 36. In certain embodiments, the electrical connection 36 may extend from the electronic circuitry in the electronics enclosure 34, through a sensor access opening (hidden by the electronics enclosure 34 in the illustrated embodiment) in the wall 30 of the frame 25 of the rain hood 24, and to the sensor 32. In other embodiments, the electrical connection 36 may extend about an edge 38 of the frame 25, where the edge 38 may at least partially define the air input opening 26. In still other embodiments, the electrical connection 36 may extend about an edge 40 of the frame 25, where the edge 40 may at least partially define the air output opening 28 of the rain hood 24, such that the electrical connection 36 extends between the edge 40 of the frame 25 of the rain hood 24 and the body 22 of the AHU 20.

In general, the sensor 32 may be an air flow sensor configured to detect air flow parameters that may be indicative of a flow rate of the air flow passing through the frame 25 of the rain hood 24 and to the body 22 of the AHU 20. For example, the sensor 32 may be a thermal dispersion air flow rate meter. In particular, the sensor 32 may include an ambient sensing element configured to monitor a temperature of the air flow, and an active sensing element configured to receive an electrical heating current to maintain a temperature differential between the ambient sensing element and the active sensing element. The sensor 32, or electronic circuitry within the electronics enclosure 34, may detect changes to the electrical heating current to deduce a flow rate from the detected changes. However, it should be noted that any suitable air flow sensor may be utilized as the sensor 32, in accordance with present embodiments. For example, the sensor 32 may include, in certain embodiments, a differential pressure sensor. It should also be noted that, while the rain hood 24 illustrated in FIG. 2 includes a generally triangular-shaped cross-section, other shapes and sizes of the rain hood 24 are also possible, as described in detail with reference to later drawings. Finally, it should be noted that certain traditional systems may include an extension of, or attached to, the body 22 and disposed downstream of the rain hood 24, and that such an extension is considered part of the body 22 of the AHU 20 and/or separate from the rain hood 24.

Figure 3:
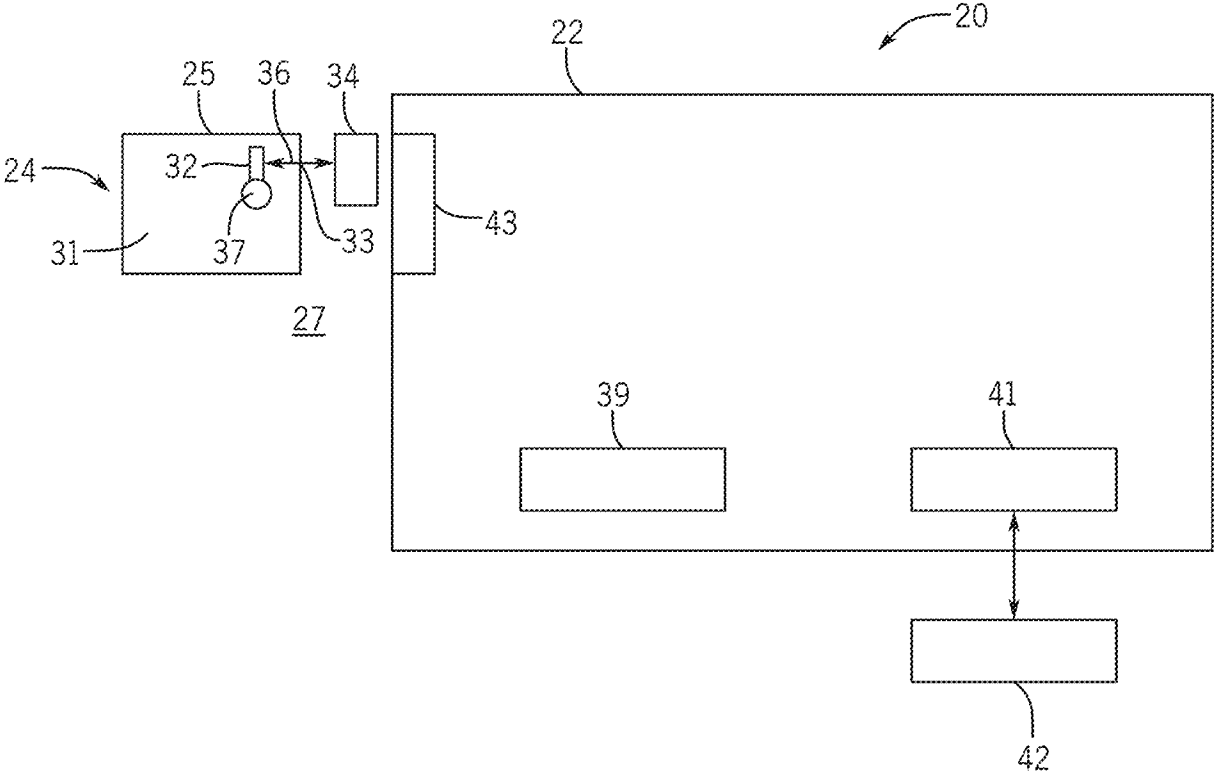
FIG. 3 is a schematic illustration of the AHU of FIG. 2, in accordance with embodiments described herein.

FIG. 3 is a schematic illustration of the AHU 20 of FIG. 2. As previously described, the AHU 20 may include the body 22 and the rain hood 24 attached to the body 22. The body 22 may include an air input opening 43, which receives an air flow from the rain hood 24, air or temperature control components 39, and/or one or more duct connections 41 for coupling to one or more ducts 42. In some embodiments, the body 22 of the AHU 20 may output air flow through an air output opening directly to a conditioned space.

In accordance with the present disclosure, the AHU 20 may also include the sensor 32 that is disposed in the interior 31 of the frame 25 of the rain hood 24 and that is configured to detect air flow parameters indicative of a flow rate of the air flow through the rain hood frame 25. As shown, the sensor 32 may include a sensing element 37. As will be described in detail with reference to later drawings, the sensing element 37 may be strategically disposed in a region of the interior 31 of the frame 25, such that the air flow over the sensor 32 is not substantially affected by boundary conditions of the frame 25, such as recirculation flow. Computational fluid dynamics may be conducted on the frame 25 to determine appropriate locations for positioning the sensor 32. Wind tunnel testing may also be conducted to verify the computation fluid dynamics data, and to ensure appropriate placement of the sensor 32. In general, disposing the sensor 32 in the interior 31 of the rain hood frame 25, as previously described, may simplify and reduce a cost of the installation process, compared to traditional embodiments which may involve disassembly of features of the AHU 20.

The electronics enclosure 34 having electronic circuitry coupled to the sensor 32 may be disposed within the external environment 27 surrounding the rain hood 24. By disposing the electronics enclosure 34 in the external environment 27, the air flow through the interior 31 of the frame 25 of the rain hood 24 is not blocked by the electronics enclosure 34. Because the electronics enclosure 34 is disposed in the external environment 27, the electronics enclosure 34 may include water-resistant components configured to block ingress of water into the electronics enclosure 34. In general, the electronics enclosure 34 may include water-resistant components configured to block ingress of liquids into the electronics enclosure. For example, the electronics enclosure 34 and corresponding water-resistant components may provide a degree of protection against ingress of water, including rain, sleet, snow, splashing water, and hose directed water, and may also protect internal components from damage due to formation of ice. In particular, the electronics enclosure 34 and corresponding water-resistant components may be configured to exclude at least 65 gallons per minute (GPM) of water from a 1-inch nozzle delivered from a distance not less than 10 feet for 5 minutes. In one embodiment, the water-resistant components of the electronics enclosure 34 may include a gasket seal and housing parts, where the gasket seal is positioned between the housing parts of the electronics enclosure 34. It should be noted that, in certain embodiments, the electronics enclosure 34 may be disposed within the interior 31 of the rain hood 25 (e.g., inwards from the rain hood frame 25).

As noted above, the electronics enclosure 34 may be disposed partially or wholly in the external environment 27 in certain embodiments. In order to couple the electronic circuitry within the electronics enclosure 34 to the sensor 32, the electrical connection 36 therebetween may extend through a sensor access opening 33 in the frame 25, which may be formed in any wall (such as the wall 30 illustrated in FIG. 2) of the frame 25. Additionally or alternatively, the electrical connection 36 may extend through air input or output openings of the frame 25, as previously described. The electrical connection 36 may be coated electronic circuitry extending from the interior of the electronics enclosure 34.

Figure 4:
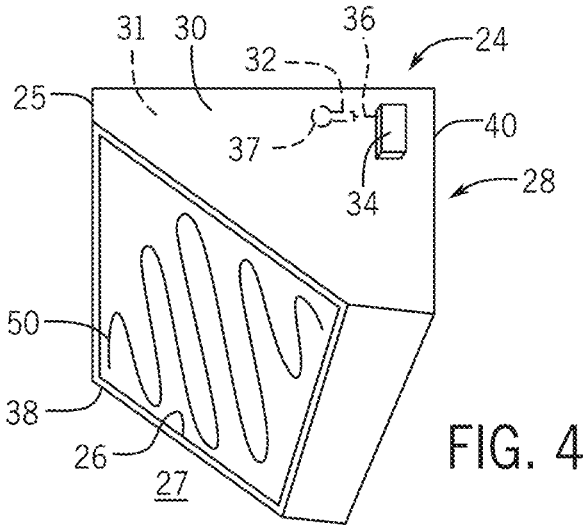
FIG. 4 is perspective view of a rain hood for use in the AHU of FIG. 2, in accordance with embodiments described herein.
Figure 5:
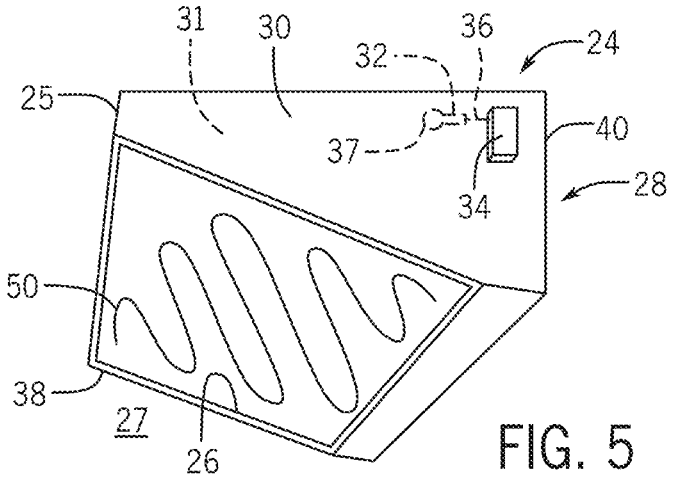
FIG. 5 is a perspective view of another rain hood for use in the AHU of FIG. 2, in accordance with embodiments described herein.
Figure 6:
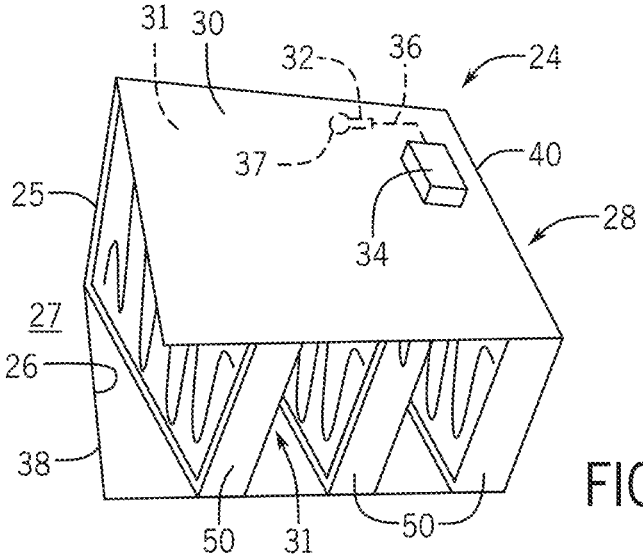
FIG. 6 is a perspective view of another rain hood for use in the AHU of FIG. 2, in accordance with embodiments described herein.

FIGS. 4-6 are perspective views of various embodiments of the rain hood 24 for use in the AHU 20 of FIG. 2. FIGS. 4 and 5 illustrate rain hoods 24 with generally triangular shapes, each of which includes a singular mesh filter 50 disposed over the air input opening 26, whereby the mesh filter 50 blocks ingress of liquids and contaminants into the frame 25. FIG. 6 illustrates an embodiment of the rain hood 24 having multiple stages of mesh filters 50. Any one of the rain hoods 24 in FIGS. 4-6 may be utilized in the AHU 20 of FIG. 2 and in accordance with the present disclosure. Further, in descriptions of later drawings, a surface of the filter 50 which the air flow first contacts may be referred to as a filter inlet, and a surface of the filter 50 opposing the filter inlet may be referred to as a filter outlet. That is, the air flow may be received by the filter inlet of the filter 50, and may exit the filter 50 via the filter outlet. It should be noted that the rain hoods 24 and corresponding filters 50 can be differentiated from louvers having fixed or adjustable slats, as understood by one of ordinary skill in the art.

Each of the illustrated rain hoods 24 in FIGS. 4-6 includes the frame 25 defining the interior 31 of the rain hood 24, the air input opening 26 defined by the edge 38 of the frame 25, and the air output opening 28 defined by the edge 40 of the frame 25. As shown in each embodiment, the electronics enclosure 34 is mounted to the illustrated wall 30 of the rain hood 24 and is disposed at least partially within the external environment 27 surrounding the rain hood 24. As previously described, the electronics enclosure 34 includes electronic circuitry housed therein. A portion of the electronic circuitry, in certain embodiments referred to as the electrical connection 36, may extend, for example, through a sensor access opening (not shown) in the wall 30 of the frame 25 and into the interior 31 of the frame 25. Thus, the electrical connection 36 may couple to the sensor 32 disposed in the interior 31, such that parameters detected by the sensing element 37 of the sensor 32 can be transmitted, via a signal, to the electronic circuitry within the electronics enclosure 34. In other embodiments, the electrical connection 36 may extend from the electronics enclosure 34 and about either one of the edges 38, 40 defining the air input opening 26 and the air output opening 28, respectively, in order to access the sensor 32 disposed in the interior 31 of the frame 25.

Figure 7:
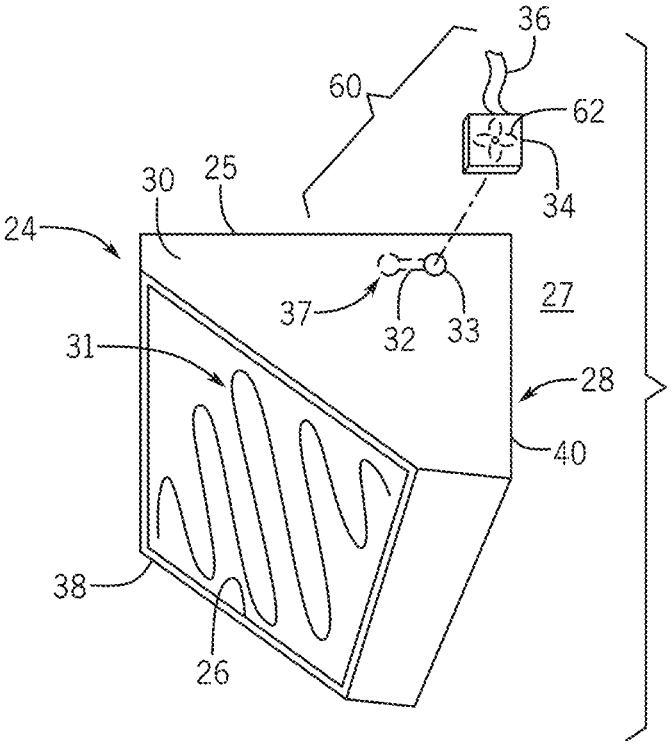
FIG. 7 is an exploded perspective view of the rain hood of FIG. 4 and a sensor assembly having an air flow sensor and an electronics enclosure, in accordance with embodiments described herein.
Figure 8:
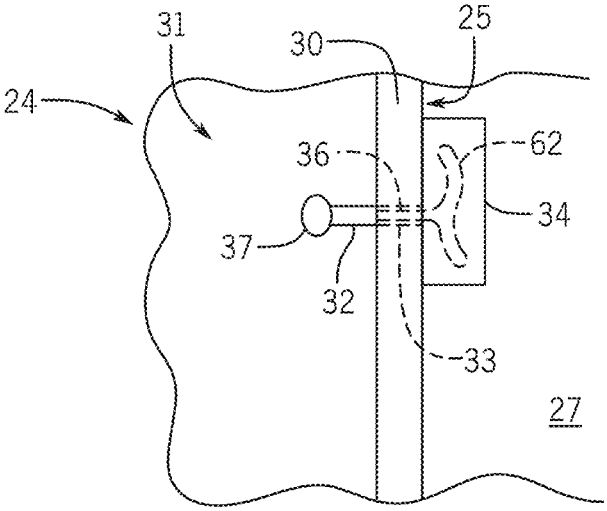
FIG. 8 is a cross-sectional side view of the sensor assembly and a wall of the rain hood of FIG. 7, in accordance with embodiments described herein.

FIG. 7 is an exploded perspective view of the rain hood 24 of FIG. 4 and a sensor assembly 60 having the air flow sensor 32 and the electronics enclosure 34. FIG. 8 is a cross-sectional side view of the sensor assembly 60 of FIG. 7 and the wall 30 of the rain hood frame 25 of FIG. 7. As shown in FIGS. 7 and 8, the wall 30 of the frame 25 of the rain hood 24 includes the sensor access opening 33 through which the electrical connection 36 extends from the electronics enclosure 34 to the sensor 32. That is, the electrical connection 36 may be coupled to electronic circuitry 62 within the electronics enclosure 34, and the electrical connection 36 is configured to extend through the sensor access opening 33 to access the sensor 32 disposed in the interior 31 of the rain hood frame 25. Although the sensor access opening 33 extends through the illustrated wall 30 of the frame 25, the sensor access opening 33 may extend through a different wall of the frame 25 in another embodiment. In other embodiments, the electrical connection 36 may extend along and/or around one of the edges 38, 40 defining one of the air input and output openings 26, 28 in order to access the sensor 32, as opposed to the illustrated sensor access opening 33.

As previously described, by disposing the sensor 32 in the rain hood 24, and in particular within the interior 31 of the rain hood frame 25, installation and maintenance of the sensor assembly 60 may be simplified, and a cost of the installation and maintenance process may be reduced. By including the electronics enclosure 34 at least partially within the external environment 27, air flow through the rain hood 24 will not be substantially blocked or impacted by the electronics enclosure 34. As previously described, the sensing element 37 of the sensor 32 may be strategically positioned in a region of the interior 31 where air flow is not substantially impacted by boundary conditions. For example, the sensing element 37 may be strategically placed to avoid recirculation flow caused by boundary conditions of the frame 25. In other words, the sensing element 37 may be positioned in a region of the interior 31 of the rain hood frame 25 having high velocity and/or uniform flow. Computational fluid dynamics may be determined to select an appropriate region for placement of the sensing element 37 with respect to a particular embodiment of the rain hood 24, and wind tunnel testing may be conducted to verify the computational fluid dynamics data. Regions for positioning the sensing element 37 will be described in detail below with reference to drawings illustrating computational fluid dynamics data of the rain hood frame 25.

Figure 9:
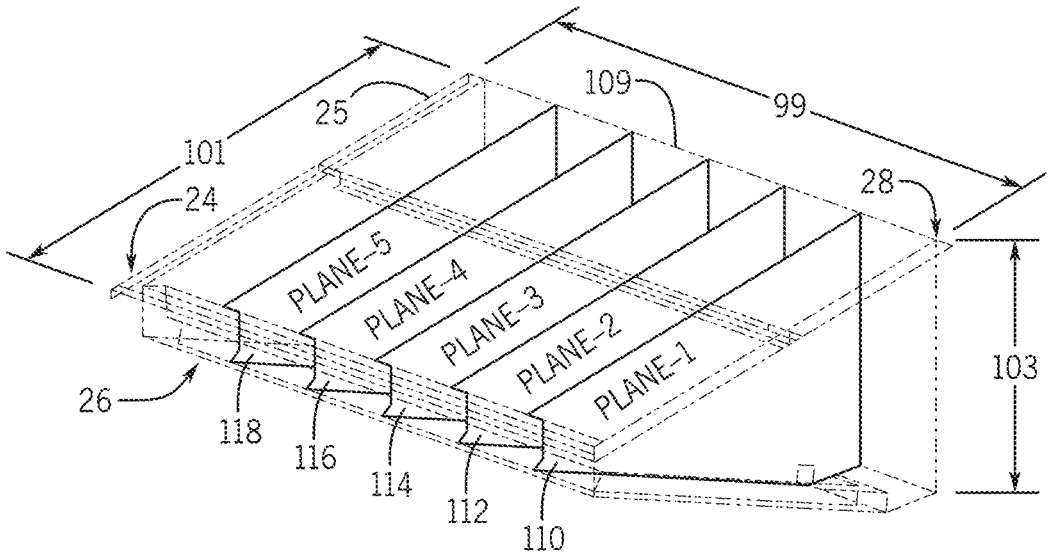
FIG. 9 is a perspective view of a rain hood for use in the AHU of FIG. 2, in accordance with embodiments described herein.
Figure 10:
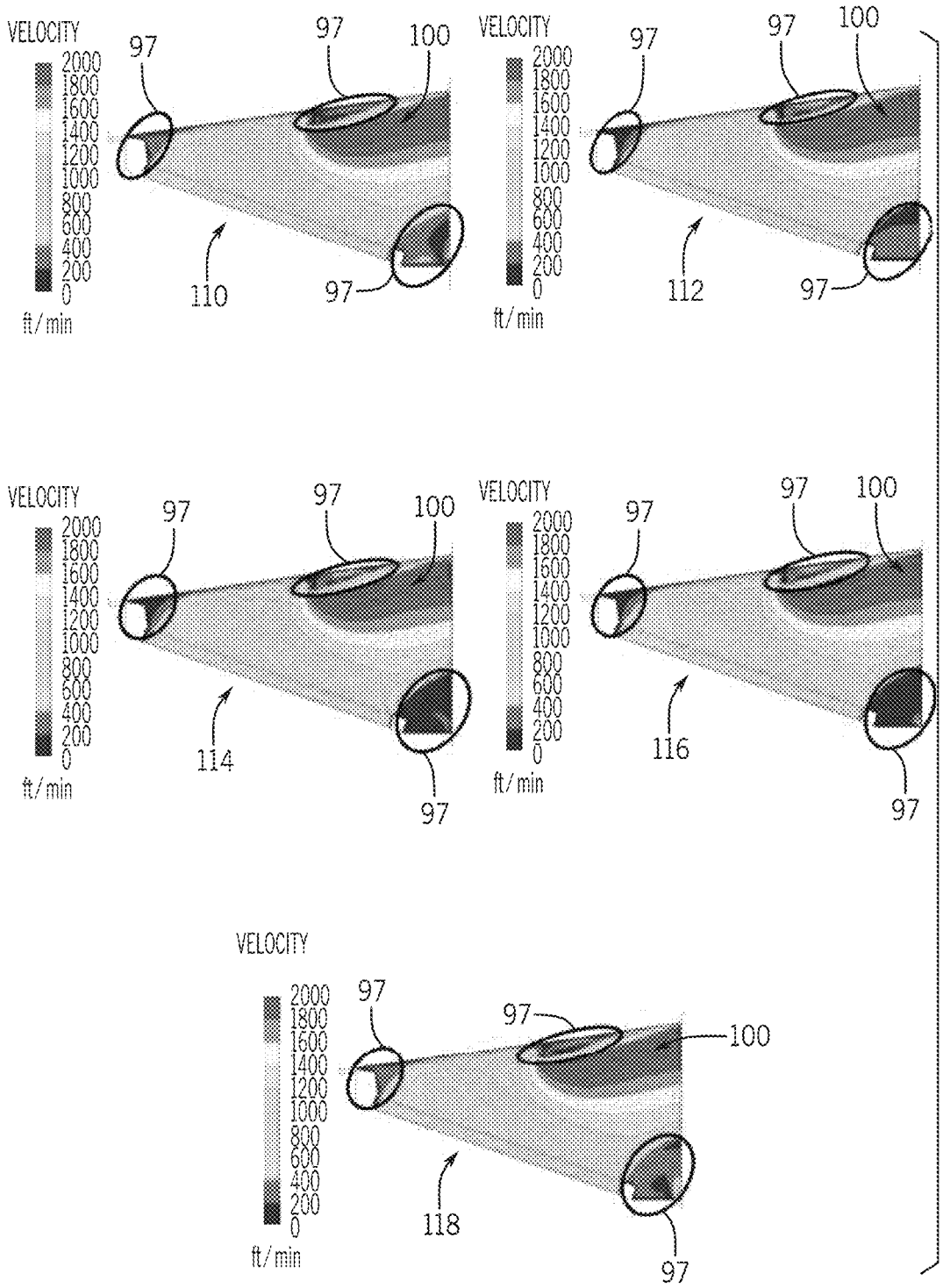
FIG. 10 is an illustration of computational fluid dynamics data showing air flow velocity at each of five planes illustrated in the rain hood of FIG. 9, in accordance with embodiments described herein.

FIG. 9 is a perspective view of an embodiment of the rain hood 24 for use in the AHU 20 of FIG. 2. FIG. 10 is an illustration of computational fluid dynamics data representing air flow velocity at each of five planes 110, 112, 114, 116, 118 illustrated in the rain hood 24 of FIG. 9. The five planes 110, 112, 114, 116, 118 illustrated in FIG. 9 are evenly spaced along a width 99 of the frame 25. As shown, the computational fluid dynamics data indicates that the air flow velocity differs slightly across each of the five planes 110, 112, 114, 116, 118. However, in general, a region 100 in a back-upper corner of each of the five planes 110, 112, 114, 116, 118 illustrated in FIG. 10 includes the highest air flow velocity, which is indicative of uniform air flow, and corresponds to a location adjacent to the air output opening 28 of the rain hood frame 25 illustrated in FIG. 9. More specifically, the region 100 illustrated in the planes 110, 112, 114, 116, 118 of FIG. 10 are adjacent to a back-upper edge 109, shown in FIG. 9, of the rain hood frame 25. Circled regions 97 in each of the five planes 110, 112, 114, 116, 118 indicate low flow velocity and are generally undesirable locations for an air flow sensor.

Figure 11:
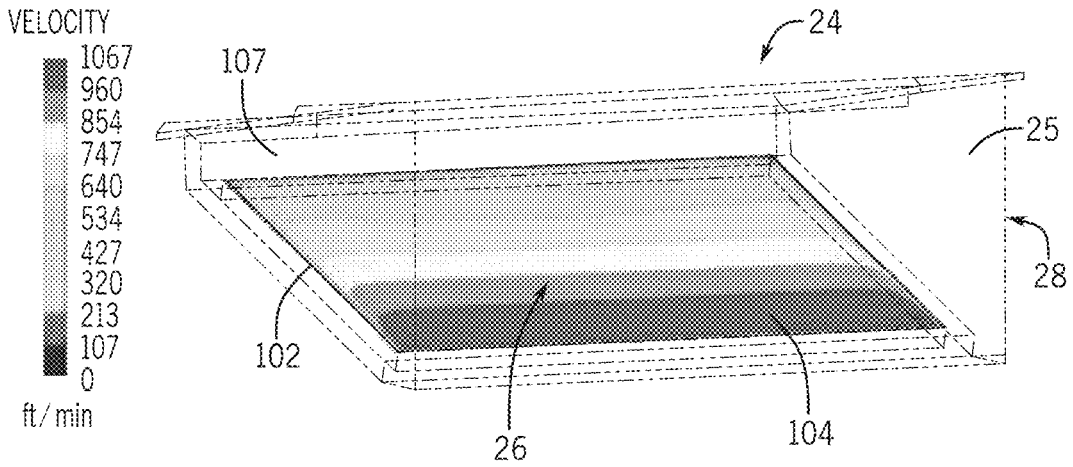
FIG. 11 is a perspective view of an illustration of computational fluid dynamics data showing air flow velocity at a filter outlet of the rain hood of FIG. 9, in accordance with embodiments described herein.

FIG. 11 is a perspective view of an illustration of computational fluid dynamics data representing air flow velocity at a filter outlet 102 of the rain hood 24 of FIG. 9. The filter, such as filter 50 in FIGS. 4 and 5, is disposed at the air input opening 26 of the rain hood 24. As previously described, the filter outlet 102 is a downstream surface of the filter, as opposed to an upstream surface. As shown, at the filter outlet 102, the air flow velocity is highest in a region 104 adjacent to the air output opening 28, which is indicative of uniform flow, as opposed to an opposing front-end surface 107 of the frame 25.

Figure 12:
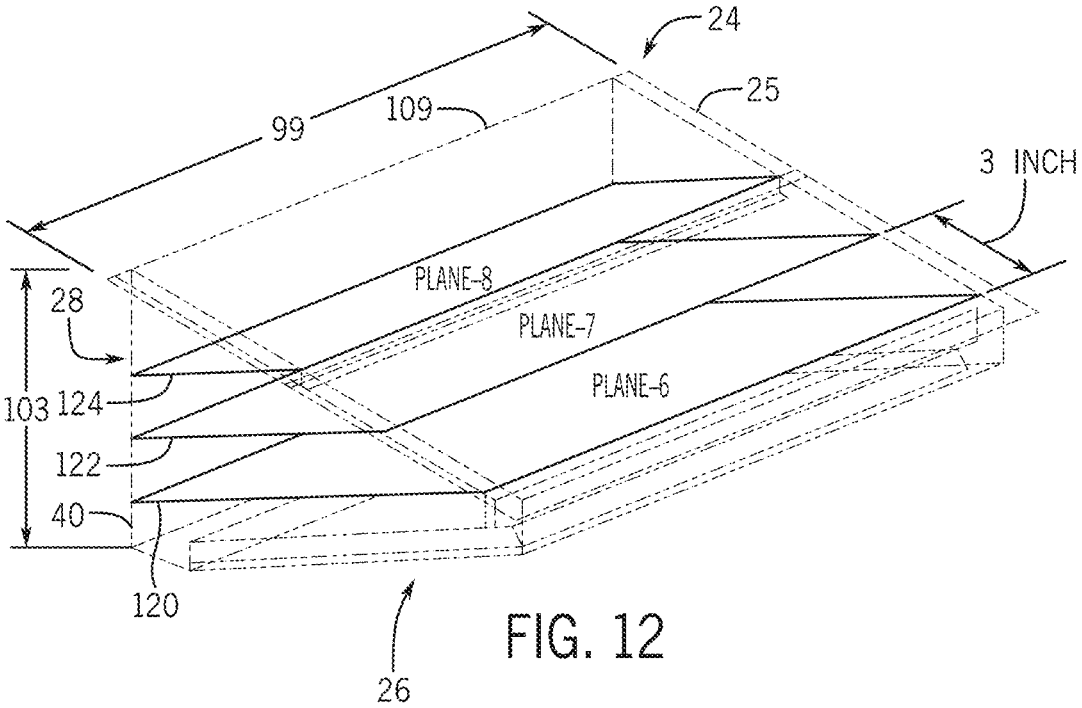
FIG. 12 is an illustration of the rain hood of FIG. 9 and three planes within an interior of the rain hood, in accordance with embodiments described herein.
Figure 13:
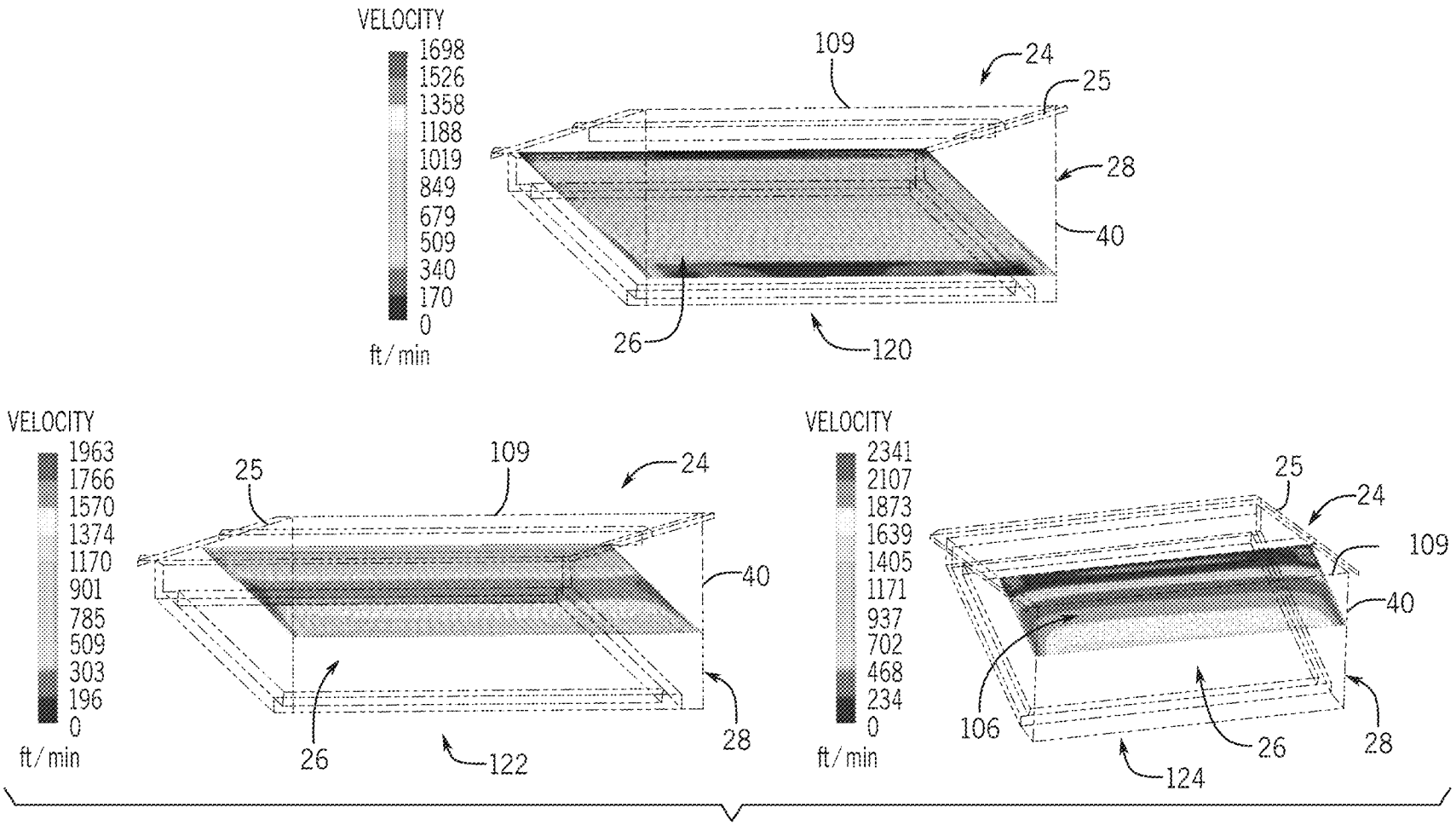
FIG. 13 is a perspective view of an illustration of computational fluid dynamics data showing air flow velocity at each of the three planes of FIG. 12, in accordance with embodiments described herein.
Figure 14:
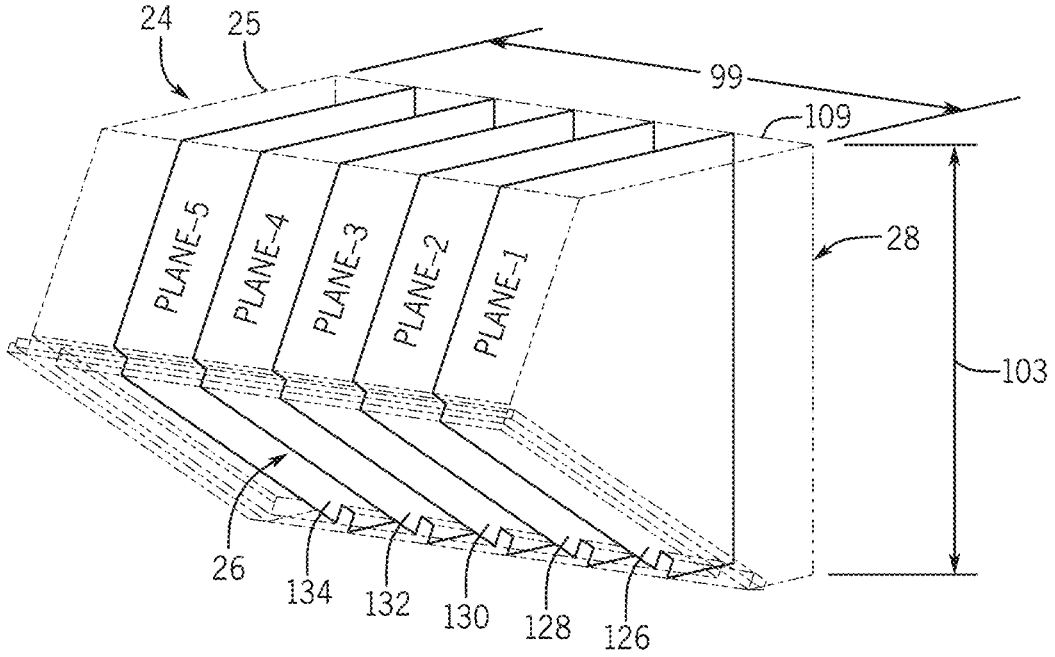
FIG. 14 is a perspective view of a rain hood for use in the AHU of FIG. 2, in accordance with embodiments described herein.
Figure 15:
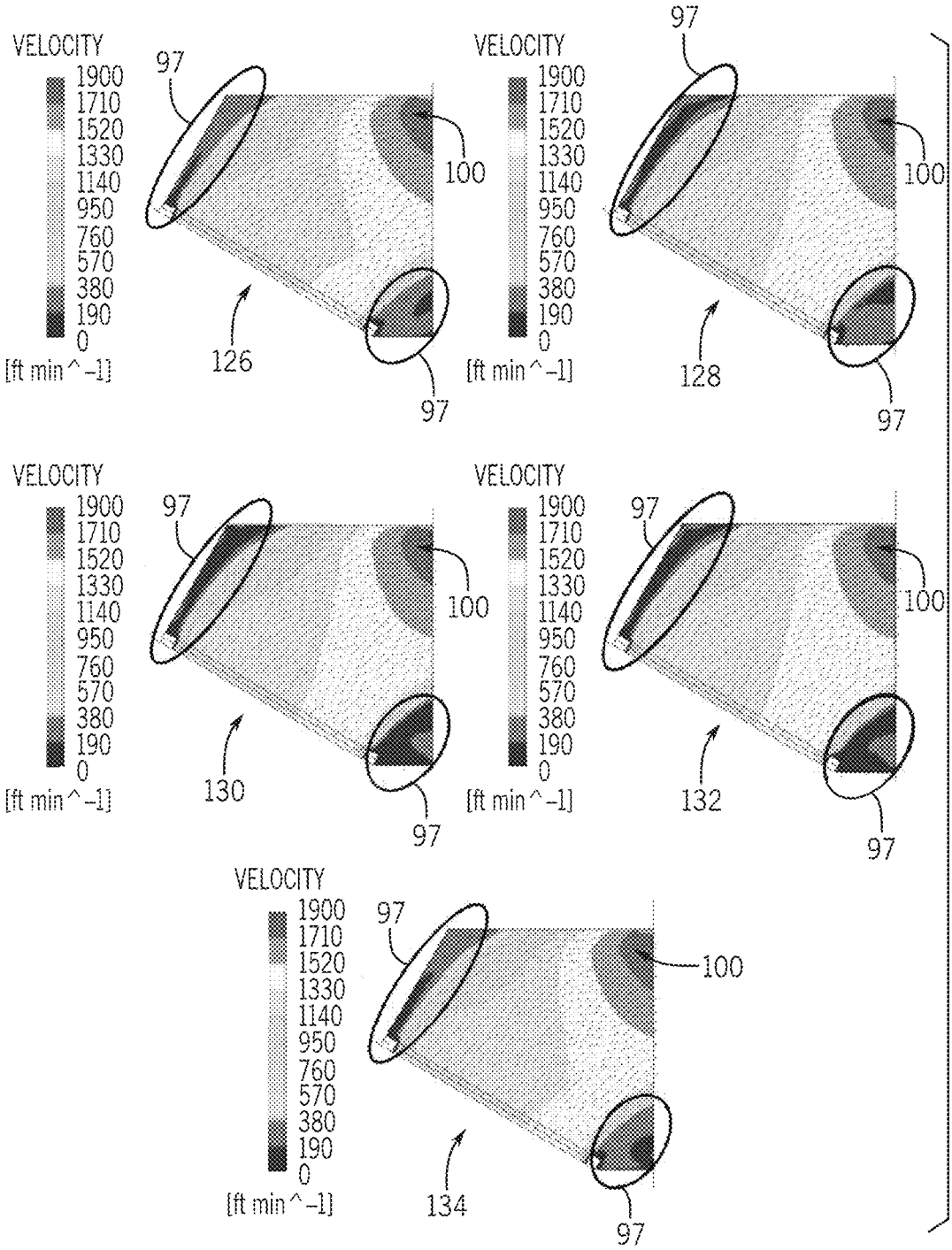
FIG. 15 is an illustration of computational fluid dynamics data showing air flow velocity at each of five planes illustrated in the rain hood of FIG. 14, in accordance with embodiments described herein.
Figure 16:
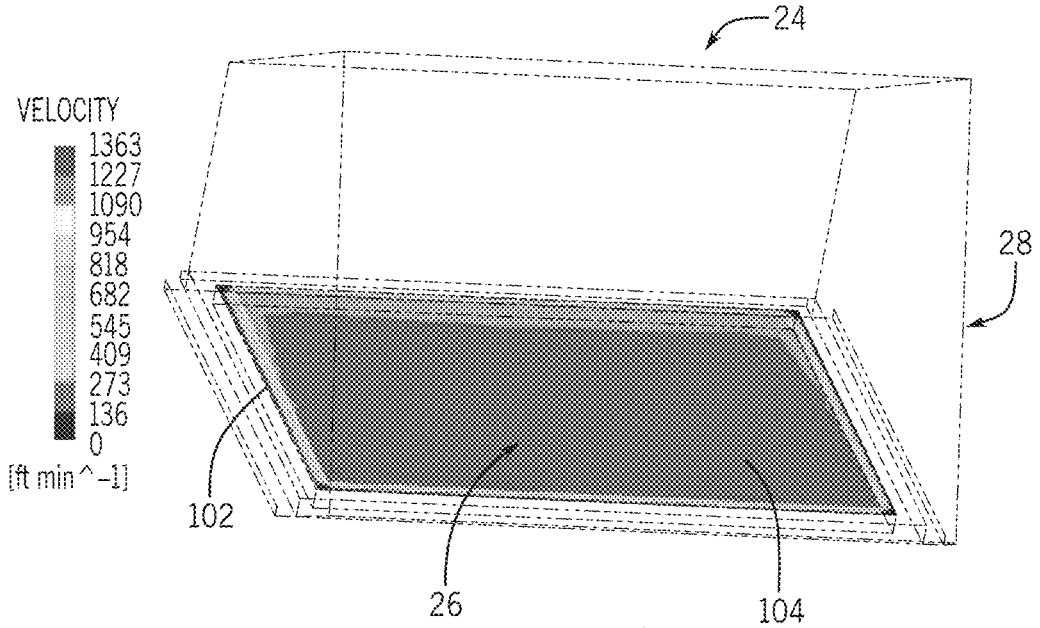
FIG. 16 is a perspective view of an illustration of computational fluid dynamics data showing air flow velocity at a filter outlet of the rain hood of FIG. 14, in accordance with embodiments described herein.

FIG. 12 is an illustration of an embodiment of the rain hood 24 of FIG. 9 and three planes 120, 122, 124 evenly spaced along a height 103 of the rain hood 24. FIG. 13 is a perspective view of an illustration of computational fluid dynamics data representing air flow velocity at each of the three planes 120, 122, 124 of FIG. 12. As shown, the air flow velocity is highest in a region 106 of plane 124, of the analyzed planes 120, 122, 124. As illustrated in FIG. 13, air flow velocity generally increases closer to a back-upper edge 109 of the frame 25 for the illustrated rain hood 24.

Figure 17:
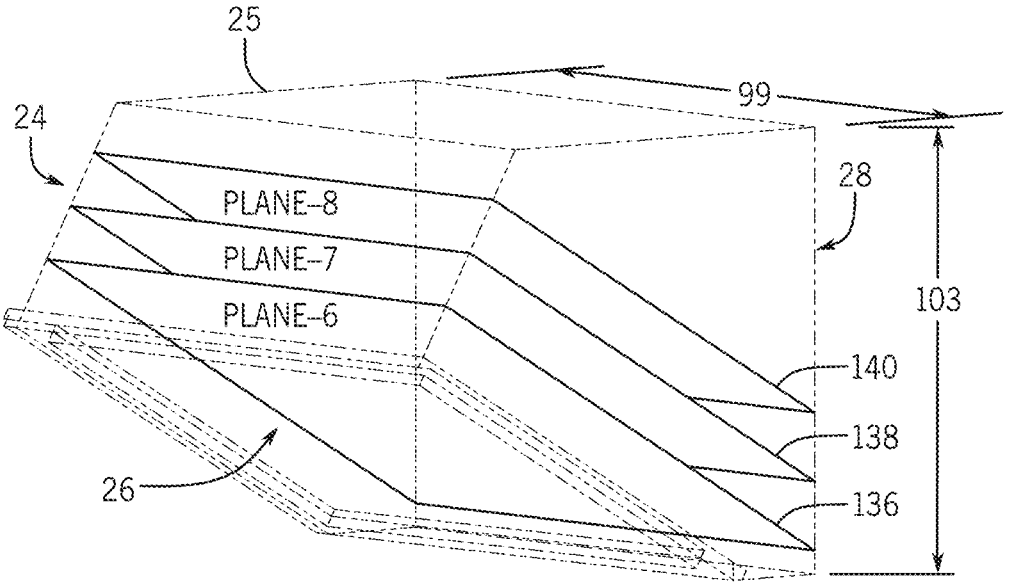
FIG. 17 is a perspective view of an illustration of the rain hood of FIG. 15 and three planes within an interior of the rain hood, in accordance with embodiments described herein.
Figure 18:
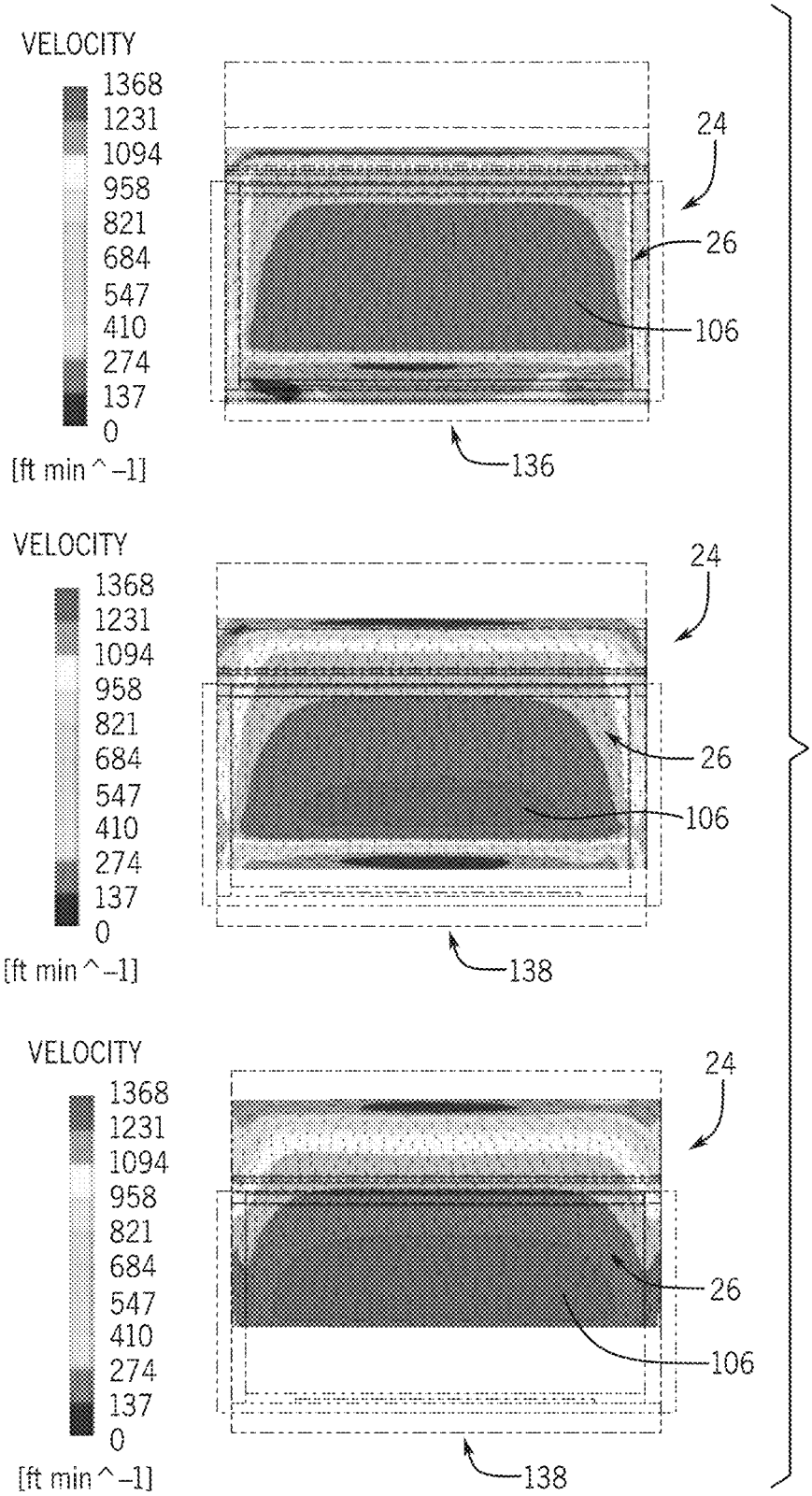
FIG. 18 is an illustration of computational fluid dynamics data showing air flow velocity at each of the three planes of FIG. 17, in accordance with embodiments described herein.
Figure 19:
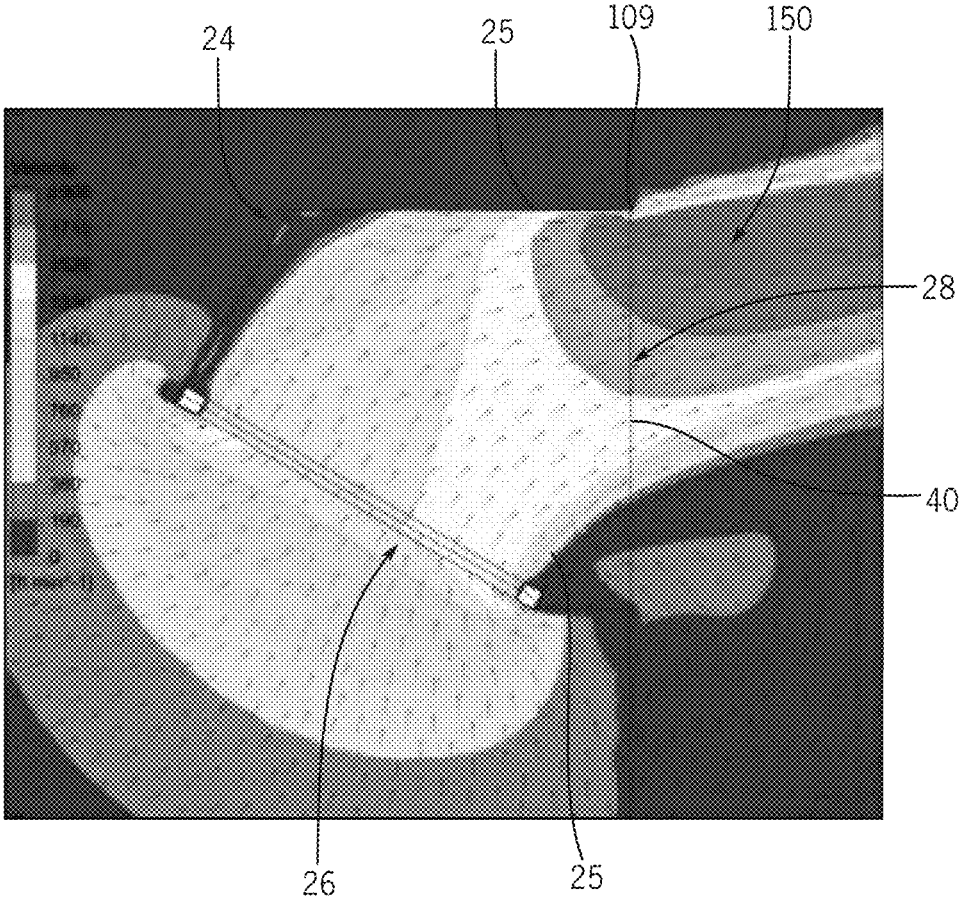
FIG. 19 is a cross-sectional side view of an illustration of computational fluid dynamics data showing air flow velocity at a mid-plane of the rain hood of FIG. 14, in accordance with embodiments described herein.

FIGS. 14-19 include illustrations of computational fluid dynamics data of air flow velocity through another embodiment of the rain hood 24. With respect to planes 126, 128, 130, 132, 134 illustrated in FIGS. 14 and 15, region 100 illustrated in a back-upper corner of each of the planes 126, 128, 130, 132, 134 in FIG. 15 includes relatively high air flow velocity. The region 100 is disposed adjacent the air output opening 28, and more specifically adjacent to the back-upper edge 109 of the frame 25. Circled regions 97 include low flow velocity and are generally undesirable for placement of a sensing element. Further, in FIG. 16, the filter outlet 102 adjacent to the air input opening 26 includes a generally high air flow velocity and, thus, generally uniform air flow. FIGS. 17 and 18 illustrate the rain hood 24 of FIG. 14 and corresponding planes 136, 138, 140 evenly spaced along a height 103 of the rain hood 24. FIG. 18 includes a front view of the rain hood 24 and each of the corresponding planes 136, 138, 140. Each plane 136, 138, 140, as shown in FIG. 18, includes a region 106 having relatively high flow velocity. FIG. 19 is a side cross-sectional view of an illustration of computational fluid dynamics data showing air flow velocity at a mid-plane of the rain hood 24 of FIG. 14, and extending through a downstream location 150 from the rain hood 24. As shown, flow velocity within the frame 25 is highest proximate to the back-upper edge 109 of the frame 25.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An air handling unit, comprising:

a rain hood configured to receive an air flow passing between the air handling unit and an external environment surrounding the rain hood; and a sensor disposed within the rain hood and configured to monitor a flow rate of the air flow, wherein the sensor is disposed in a location of the rain hood, the location being closer to an air output opening of the rain hood than an air input opening of the rain hood.

2. The air handling unit of claim 1, wherein the sensor is a thermal dispersion air flow rate meter.

3. The air handling unit of claim 1, wherein the sensor is a differential pressure sensor.

4. The air handling unit of claim 1, comprising a water-resistant electronics enclosure and electronic circuitry disposed within the water-resistant electronics enclosure, wherein the electronic circuitry is communicatively coupled to the sensor, and wherein the water-resistant electronics enclosure is disposed at least partially within the external environment.

5. The air handling unit of claim 4, wherein the rain hood includes a frame having the air input opening configured to receive the air flow therethrough and having a sensor access opening extending through a wall of the frame to enable coupling between the electronic circuitry and the sensor.

6. The air handling unit of claim 4, wherein the water-resistant electronics enclosure includes water-resistant components configured to exclude at least 65 gallons per minute (GPM) of water from a 1-inch nozzle delivered from a distance not less than 10 feet for 5 minutes.

7. The air handling unit of claim 1, wherein the rain hood includes a frame having the air input opening and a mesh filter disposed over the air input opening.

8. The air handling unit of claim 1, comprising:

a rain hood frame of the rain hood and the air input opening defined by an edge of the rain hood frame;

an electronics enclosure disposed at least partially within the external environment and having electronic circuitry housed therein; and an electrical connection extending between the electronic circuitry and the sensor, wherein the electrical connection extends across the edge of the rain hood frame.

9. The air handling unit of claim 1, wherein the sensor is disposed in a region adjacent to a back-upper edge of the rain hood, and the back-upper edge is disposed adjacent to the air output opening of the rain hood.

10. The air handling unit of claim 1, comprising an electronics enclosure and electronic circuitry disposed within the electronics enclosure, wherein the electronic circuitry is communicatively coupled to the sensor, and wherein the electronics enclosure is disposed within the rain hood.

11. An air handling unit, comprising:

a rain hood frame defining a rain hood interior and having an air input opening configured to receive an air flow from an external environment surrounding the rain hood frame;

an air flow sensor disposed within the rain hood interior and configured to monitor a flow rate of the air flow, wherein the air flow sensor is disposed closer to an air output opening of the rain hood frame than the air input opening of the rain hood frame; and an electronics enclosure disposed at least partially within the external environment and having electronic circuitry disposed therein, wherein the air flow sensor is communicatively coupled to the electronic circuitry.

12. The air handling unit of claim 11, comprising:

a sensor access opening formed through a wall of the rain hood frame; and an electrical connection extending through the sensor access opening and communicatively coupling the electronic circuitry and the air flow sensor.

13. The air handling unit of claim 11, comprising an electrical connection between the electronic circuitry and the air flow sensor, wherein the air input opening of the rain hood frame is defined by an edge of the rain hood frame and the electric connection extends adjacent the edge.

14. The air handling unit of claim 11, wherein the electronics enclosure is a water-resistant electronics enclosure having water-resistant components.

15. The air handling unit of claim 11, wherein the air flow sensor is a thermal dispersion air flow rate meter.

16. The air handling unit of claim 11, wherein the air flow sensor is a differential pressure sensor.

17. A heating, ventilation, and/or air conditioning (HVAC) system comprising:

a rain hood frame defining a rain hood interior, wherein the rain hood frame includes an air input opening configured to receive an air flow from an external environment surrounding the rain hood frame and includes a sensor access opening formed in a wall of the rain hood frame;

an air flow sensor disposed within the rain hood interior and configured to detect a flow rate of the air flow, wherein the air flow sensor is disposed in a location of the rain hood interior that is closer to an air output opening of the rain hood frame than the air input opening of the rain hood frame; and an electronics enclosure disposed at least partially within the external environment and having electronic circuitry disposed therein, wherein the electronic circuitry is coupled to the air flow sensor via the sensor access opening.

18. The HVAC system of claim 17, wherein the rain hood frame includes a filter disposed over the air input opening.

19. The HVAC system of claim 17, wherein the electronics enclosure is a water-resistant electronics enclosure having water-resistant components.

20. The HVAC system of claim 19, wherein the water-resistant components are configured to exclude at least 65 gallons per minute (GPM) of water from a 1-inch nozzle delivered from a distance not less than 10 feet for 5 minutes.

21. The HVAC system of claim 17, wherein the air flow sensor is a thermal dispersion air flow rate meter.

22. The HVAC system of claim 17, comprising an air handling unit having the rain hood frame, the air flow sensor, and the electronics enclosure.

* * * * *